US006014869A

United States Patent [19]

Elion et al.

[11] Patent Number: 6,014,869

[45] Date of Patent: Jan. 18, 2000

[54] REDUCING THE AMOUNT OF COMPONENTS HAVING LOW BOILING POINTS IN LIQUEFIED NATURAL GAS

[75] Inventors: Wiveka Jacoba Elion; Robert Klein Nagelvoort; Jan Kornelis Vink, all of The Hague, Netherlands

[73] Assignee: Shell Research Limited, London, United Kingdom

[21] Appl. No.: 09/117,769

[22] PCT Filed: Feb. 27, 1997

[86] PCT No.: PCT/EP97/01000

§ 371 Date: Aug. 5, 1998

§ 102(e) Date: Aug. 5, 1998

[87] PCT Pub. No.: WO97/32172

PCT Pub. Date: Sep. 4, 1997

[30] Foreign Application Priority Data

Feb. 29, 1996 [EP] European Pat. Off. ..... 96200521

[51] Int. Cl.[7] ..... F25J 3/00

[52] U.S. Cl. ..... 62/621; 62/613; 62/619

[58] Field of Search ..... 62/613, 619, 621

[56] References Cited

U.S. PATENT DOCUMENTS

| | | | |
|---|---|---|---|
| 3,837,172 | 9/1974 | Markbreiter et al. | 62/621 |
| 3,915,680 | 10/1975 | Crawford et al. . | |
| 4,273,566 | 6/1981 | Schwarz | 62/620 |
| 4,453,958 | 6/1984 | Gulsby et al. | 62/621 |
| 4,479,871 | 10/1984 | Pahade . | |

FOREIGN PATENT DOCUMENTS

| | | |
|---|---|---|
| 35-31-307 | 3/1987 | Germany . |
| 1-180-490 | 2/1970 | United Kingdom . |

OTHER PUBLICATIONS

Search Report dated May 20, 1997.

*Primary Examiner*—Ronald Capossela

[57] ABSTRACT

Method of reducing the amount of components having low boiling points in liquefied natural gas comprising passing the liquefied natural gas at liquefaction pressure through the hot side of an external heat exchanger to obtain cooled liquefied natural gas, allowing the cooled liquefied natural gas to expand dynamically to an intermediate pressure and statically to a low pressure to obtain expanded fluid, and introducing expanded fluid into the upper part of a fractionation column provided with a contacting section arranged between the upper part and the lower part of the fractionation column; passing a direct side stream at low pressure through the cold side of the external heat exchanger to obtain heated two-phase fluid; introducing the heated two-phase fluid into the lower part of the fractionation column and allowing the vapor to flow upwards through the contacting section; allowing the liquid of the expanded fluid to flow downwards through the contacting section; and withdrawing from the lower part of the fractionation column a liquid product stream having a reduced content of components having low boiling points, and from the upper part of the fractionation column a gas stream which is enriched in components having low boiling points.

5 Claims, 2 Drawing Sheets

REDUCING THE AMOUNT OF COMPONENTS HAVING LOW BOILING POINTS IN LIQUEFIED NATURAL GAS

The present invention relates to a method of reducing the amount of components having low boiling points in liquefied natural gas. The components having low boiling points are generally nitrogen, helium and hydrogen, these components are also called 'light components'. In such a method the liquefied natural gas is liquefied at liquefaction pressure, and subsequently the pressure of the liquefied natural gas is reduced and separated to obtain liquefied natural gas having a reduced content of components having a low boiling point at a low pressure, which liquefied natural gas can be further treated or stored. Thus this method serves two ends, first reducing the pressure of the liquefied natural gas to the low pressure, and second separating a gas stream including components having low boiling points from the liquefied natural gas, thus ensuring that the remaining liquefied natural gas has a sufficiently low content of components having low boiling points. In general the contents of low boiling point components, in particular nitrogen, is reduced from between 2 to over 15 mol % to less than 1 mol %. Such a method is sometimes called an end flash method.

The liquefaction pressure of natural gas is generally in the range of from 3.0 to 6.0 MPa. The low pressure is below the liquefaction pressure, for example the low pressure is less than 0.3 MPa and suitably the low pressure is about atmospheric pressure, between 0.10 and 0.15 MPa.

International patent application publication No. WO 93/08 436 relates to a method of reducing the amount of components having low boiling points in liquefied natural gas, which method comprises the steps of:

(a) passing the liquefied natural gas at liquefaction pressure or at an intermediate pressure through the hot side of an external heat exchanger to obtain cooled liquefied natural gas, allowing the cooled liquefied natural gas to expand to a low pressure to obtain expanded fluid, and introducing the expanded fluid into the upper part of a fractionation column provided with a contacting section arranged between the upper part and the lower part of the fractionation column;

(b) passing a liquefied natural gas fraction withdrawn from the fractionation column through the cold side of the external heat exchanger to obtain heated two-phase fluid;

(c) introducing the heated two-phase fluid into the lower part of the fractionation column and allowing the vapour to flow upwards through the contacting section;

(d) allowing the liquid of the expanded fluid introduced in the upper part of the fractionation column to flow downwards through the contacting section; and (e) withdrawing from the lower part of the fractionation column a liquid product stream having a reduced content of components having low boiling points, and withdrawing from the upper part of the fractionation column a gas stream which is enriched in components having low boiling points, wherein the expansion from liquefaction pressure to intermediate pressure is done dynamically and wherein the expansion from the intermediate pressure to low pressure is done statically.

The intermediate pressure is in between the liquefaction pressure and the low pressure, and it is so selected that evaporation during the dynamic expansion is substantially avoided.

In the known method, a fraction is withdrawn from the fractionation column which is heated in the external heat exchanger to provided vapour for stripping. The fraction is a normal side stream which is removed from the fractionation column at a level within the contacting section, which contacting section is arranged below the level at which the expanded fluid is introduced in the upper part of a fractionation column. For example if the contacting section comprises contacting trays, the fraction is removed from a level between adjacent contacting trays. Consequently the fraction has been in intimate contact with vapour rising through the fractionation column before it is removed from the fractionation column. A result of this intimate contact is that matter and heat are exchanged between the liquid and the vapour. Thus not only the composition of the liquid is changed but also the liquid is heated.

In the specification the words 'gas' and 'vapour' will be used indifferently.

Applicant seeks to improve the above method, and to provide a method wherein the coldest fluid available is passed through the cold side of the external heat exchanger.

To this end the method of reducing the amount of components having low boiling points in liquefied natural gas according to the present invention comprises the steps of:

(a) passing the liquefied natural gas at liquefaction pressure or at an intermediate pressure through the hot side of an external heat exchanger to obtain cooled liquefied natural gas, allowing the cooled liquefied natural gas to expand to a low pressure to obtain expanded fluid, and introducing expanded fluid into the upper part of a fractionation column provided with a contacting section arranged between the upper part and the lower part of the fractionation column;

(b) passing a direct side stream at low pressure through the cold side of the external heat exchanger to obtain heated two-phase fluid, which direct side stream is a liquid portion of the liquefied natural gas separated therefrom at a point which is upstream of the contacting section in the fractionation column, and suitably separated therefrom at a point which is downstream of the external heat exchanger and upstream of the contacting section in the fractionation column;

(c) introducing the heated two-phase fluid into the lower part of the fractionation column and allowing the vapour to flow upwards through the contacting section;

(d) allowing the liquid of the expanded fluid introduced in the upper part of the fractionation column to flow downwards through the contacting section; and (e) withdrawing from the lower part of the fractionation column a liquid product stream having a reduced content of components having low boiling points, and withdrawing from the upper part of the fractionation column a gas stream which is enriched in components having low boiling points, wherein the expansion from liquefaction pressure to intermediate pressure is done dynamically and wherein the expansion from intermediate pressure to low pressure is done statically.

An advantage of the present invention is that the liquid load in the contacting section of the fractionation column is reduced, consequently the stripping factor is increased and thus the stripping efficiency.

The invention will now be described in more detail with reference to the accompanying drawings, wherein FIG. 1 shows a first embodiment of the present invention;

Figure 1:
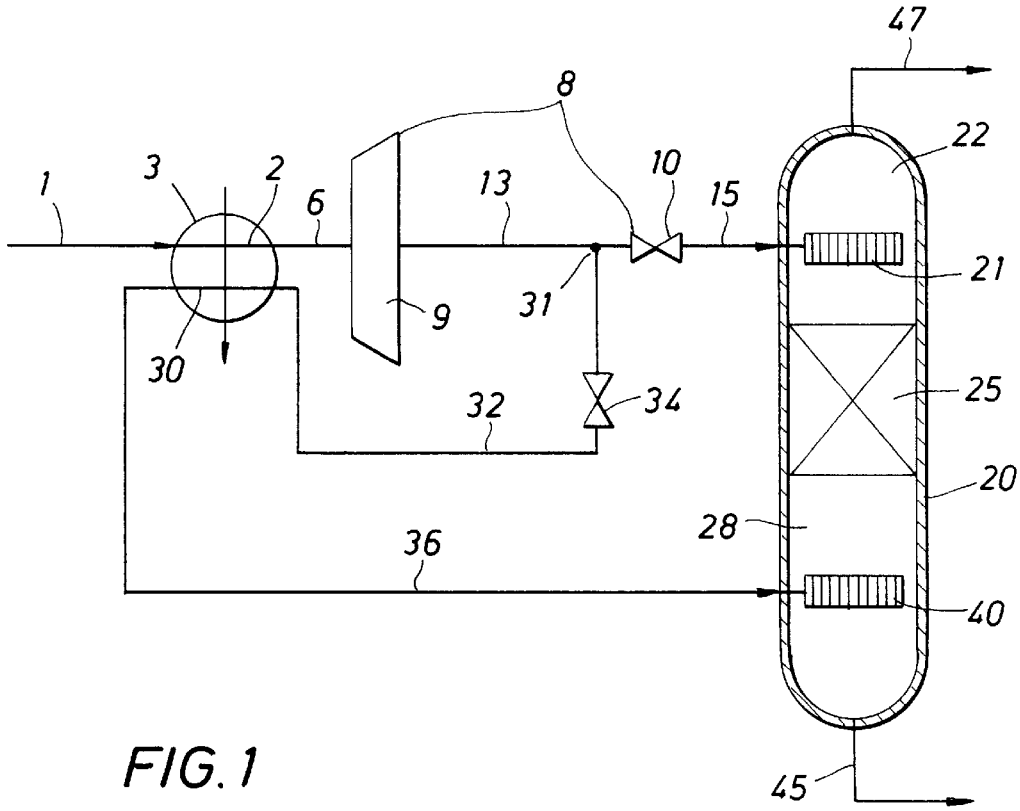

Reference is made to FIG. 1. The liquefied natural gas is supplied at liquefaction pressure through conduit 1 to the hot side 2 of external heat exchanger 3. In the external heat exchanger 3 the liquefied natural gas is cooled by indirect heat exchange to obtain cooled liquefied natural gas. The cooled liquefied natural gas is supplied through conduit 6 to expansion unit 8, which expansion unit 8 comprises a device for dynamically expanding liquid in the form of a turbo expander 9 to expand the cooled liquefied natural gas dynamically from liquefaction pressure to an intermediate pressure and a throttling valve 10 to expand the cooled liquefied natural gas statically from the intermediate pressure to a low pressure to obtain expanded fluid. The turbo expander 9 and the throttling valve 10 are connected by means of connecting conduit 13. The expanded fluid is subsequently supplied through conduit 15 to a fractionation column 20 operating at the low pressure.

The expanded fluid is introduced via inlet device 21 into the upper part 22 of the fractionation column 20. The fractionation column 20 is provided with a contacting section 25 arranged between the upper part 22 and the lower part 28 of the fractionation column 20. The contacting section 25 may be formed by a number of axially spaced apart contacting trays or by packing material to provide intimate contact between gas and liquid, the number of contacting trays or the height of the packing material is so selected that it provided fractionation corresponding to the fractionation provided by at least on theoretical equilibrium stage, and suitably by between 3 to 10 stages.

In the external heat exchanger 3 the liquefied natural gas is cooled by indirect heat exchange with a direct side stream at low pressure passing through the cold side 30 of the external heat exchanger 3 to obtain heated two-phase fluid.

The direct side stream is obtained by taking a portion of the cooled liquefied natural gas at intermediate pressure and allowing it to expand statically to the low pressure. The portion is removed from the cooled liquefied natural gas at junction 31 and supplied through conduit 32 provided with throttling valve 34 to the cold side 30 of the heat exchanger 3.

The heated two-phase fluid is passed at the low pressure through conduit 36 to the fractionation column 20, and it is introduced through inlet device 40 into the lower part 28 of the fractionation column 20. The vapour from the heated two-phase fluid is allowed to flow upwards through the contacting section 25.

The liquid of the expanded fluid to flow downwards through the contacting section 25, counter-currently to the vapour.

A liquid product stream containing a reduced amount of components having low boiling points is withdrawn from the lower part of the fractionation column 20 through conduit 45, and a gas stream which is enriched in components having low boiling points is withdrawn from the upper part of the fractionation column 20 through conduit 47.

Because the direct side stream is removed from the cooled liquefied natural gas at junction 13 it has not been subjected to a fractionation, and therefore it has not been heated. Moreover, because the amount of liquid flowing downwards through the fractionation column is the amount of liquid in the liquefied natural gas minus the amount of the direct side stream, the liquid load in the fractionation column is reduced and consequently the stripping efficiency is improved.

As shown in FIG. 1 the turbo expanded 9 is arranged downstream of the external heat exchanger 3, so that the liquefied natural gas passes at liquefaction pressure through the hot side 2 of the external heat exchanger 3. In an alternative embodiment (not shown) the turbo expander is arranged upstream of the direct heat exchanger so that the liquefied natural gas passes at intermediate pressure through the hot side 2 of the external heat exchanger 3.

Figure 2:
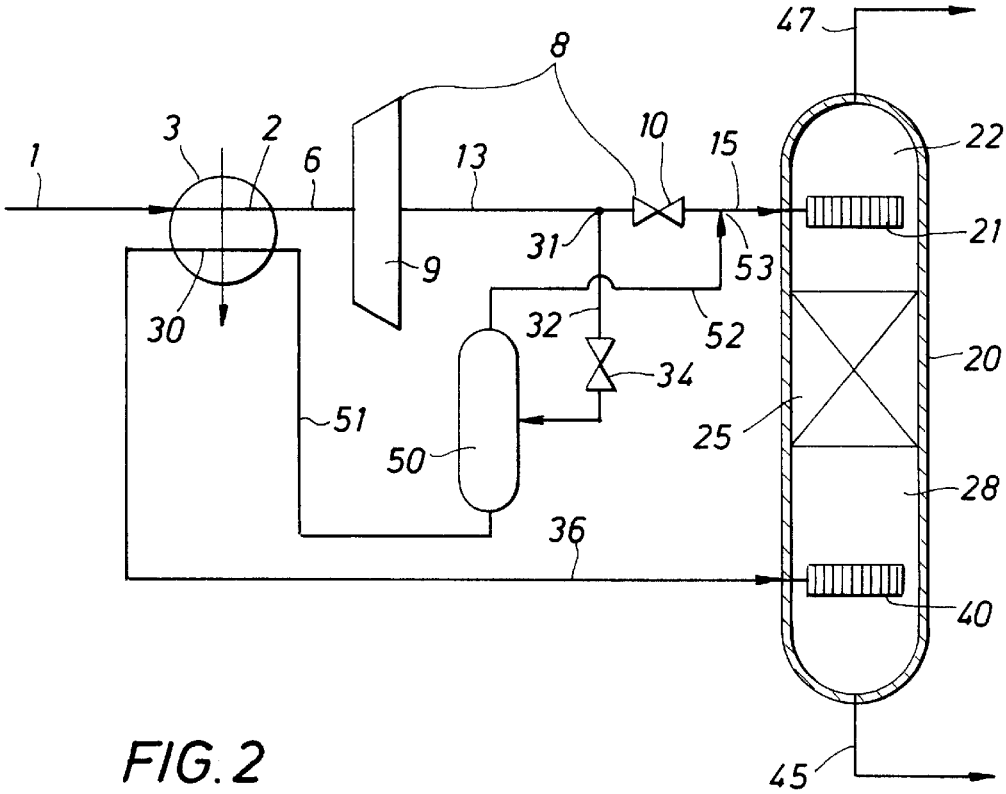
FIG. 2 shows a second embodiment of the present invention.

Reference is now made to FIG. 2 showing an alternative embodiment of the present invention. The parts which correspond to parts shown in FIG. 1 have got the same reference numerals.

The embodiment of FIG. 2 differs only from the one shown in FIG. 1 in that the direct side stream is obtained in a different way, and the remainder stays the same so that the normal operation will not be discussed in detail. In the embodiment of FIG. 2, the direct side stream is obtained as follows. A portion of the cooled liquefied natural gas at intermediate pressure is removed from the cooled liquefied natural gas at junction 31 and supplied through conduit 32 provided with throttling valve 34 to a separator 50. In the separator 50 vapour is removed from the portion and the liquid is passed through conduit 51 to the cold side 30 of the heat exchanger 3.

Suitably the vapour is passed through conduit 52 and it is added to the expanded fluid at junction 53 before it enters into the fractionation column 20.

Figure 3:
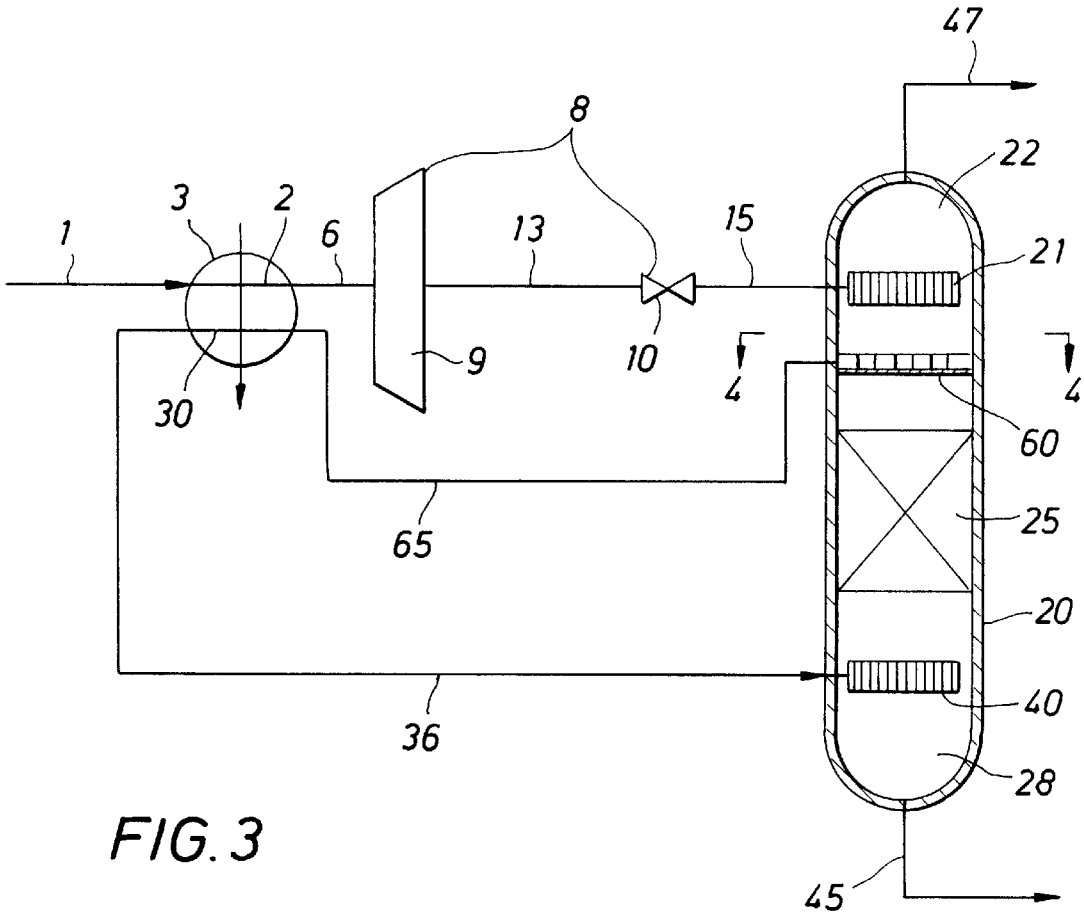
FIG. 3 shows a third embodiment of the present invention.
Figure 4:
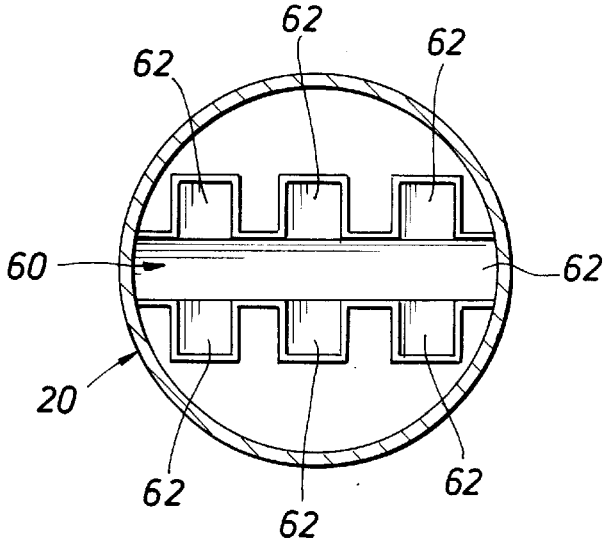
FIG. 4 shows a cross-section of FIG. 3 along the line IV—IV drawn to a larger scale.

An improvement of the embodiment of FIG. 2 is now described with reference to FIGS. 3 and 4. The parts which correspond to parts shown in FIG. 1 have got the same reference numerals, and only the operation of the different features will be described.

In this improved embodiment, the direct side stream is obtained by withdrawing a side stream from the upper part 22 of the fractionation column 20. To this end a partial draw-off tray 60 is arranged in the upper part 22 of the fractionation column 20 below the level at which expanded fluid is introduced and above the contacting section 25. The partial draw-off tray comprises a central trough 62 (see FIG. 4) and a plurality of side troughs 62 opening into the central trough 61. The fractionation column 20 is provided with an outlet (not shown) for withdrawing liquid collected by the partial draw-off tray 60.

During normal operation the expanded fluid is introduced into the fractionation column 20 through inlet device 21 and part of the liquid downflow is collected by the partial draw-off tray 60 and passed as the direct side stream to the external heat exchanger through conduit 65. A partial draw-off tray as referred to with reference numeral 60 is a tray which does not provide intimate gas/liquid contact. Thus the liquid withdrawn from the tray has the same composition as the liquid entering the tray, and consequently vapour and liquid leaving the tray are not in equilibrium with each other. Therefore such a partial draw-off tray is not a theoretical equilibrium stage.

The amount of direct side stream is between 10 to 60 mol % based on the amount of liquefied natural gas.

An advantage of the method of the present invention over the known method is that the direct side stream, a liquid portion of the liquefied natural gas separated therefrom at a point which is downstream of the external heat exchanger and upstream of the contacting section in the fractionation column, has not been subjected to fractionation so that it is the coldest stream available.

A further advantage of the present invention is that the liquid load in the contacting section of the fractionation column is reduced, consequently the stripping factor is increased and thus the stripping efficiency.

We claim:

1. Method of reducing the amount of components having low boiling points in liquefied natural gas, which method comprises the steps of:

(a) passing the liquefied natural gas at liquefaction pressure or at an intermediate pressure through the hot side of an external heat exchanger to obtained cooled liquefied natural gas, allowing the cooled liquefied natural gas to expand to a low pressure to obtain expanded fluid, and introducing expanded fluid into the upper part of a fractionation column provided with a contacting section arranged between the upper part and the lower part of the fractionation column;

(b) passing a direct side stream at low pressure through the cold side of the external heat exchanger to obtain heated two-phase fluid, which direct side stream is a liquid portion of the liquefied natural gas separated therefrom at a point which is upstream of the contacting section in the fractionation column, and suitably separated therefrom at a point which is downstream of the external heat exchanger and upstream of the contacting section in the fractionation column;

(c) introducing the heated-two phase fluid into the lower part of the fractional column and allowing the vapour to flow upwards through the contacting section;

(d) allowing the liquid of the expanded fluid introduced in the upper part of the fractionation column to flow downwards through the contacting section; and (e) withdrawing from the lower part of the fractionation column a liquid product stream having a reduced content of components having low boiling points, and withdrawing from the upper part of the fractionation column a gas stream which is enriched in components having low boiling points, wherein the expansion from liquefaction pressure to intermediate pressure is done dynamically and wherein the expansion from intermediate pressure to low pressure is done statically.

2. Method according to claim 1, wherein the direct side stream is obtained by taking a portion of the cooled liquefied natural gas at intermediate pressure and allowing it to expand statically to the low pressure.

3. Method according to claim 1, wherein the direct side stream is the liquid obtained by taking a portion of the cooled liquefied natural gas at intermediate pressure, allowing it to expand statically to the low pressure to obtain a two-phase fluid, and removing the vapour from the two-phase fluid.

4. Method according to claim 3, wherein the vapour is added to the expanded fluid before it is entered into the fractionation column.

5. Method according to claim 1, wherein the direct side stream is obtained by withdrawing a side stream from the upper part of the fractionation column.

* * * * *